US005159621A

United States Patent [19]

Watanabe et al.

[11] Patent Number: 5,159,621

[45] Date of Patent: Oct. 27, 1992

[54] X-RAY TRANSMITTING WINDOW AND METHOD OF MOUNTING THE SAME

[75] Inventors: Yutaka Watanabe, Isehara; Shunichi Uzawa, Tokyo; Yasuaki Fukuda, Hadano; Nobutoshi Mizusawa, Yamato; Ryuichi Ebinuma, Machida; Mitsuaki Amemiya, Atsugi, all of Japan

[73] Assignee: Canon Kabushiki Kaisha, Tokyo, Japan

[21] Appl. No.: 739,259

[22] Filed: Aug. 1, 1991

[30] Foreign Application Priority Data

Aug. 1, 1990 [JP] Japan ..... 2-202530
Jul. 8, 1991 [JP] Japan ..... 3-167059

[51] Int. Cl.[5] ..... G21K 1/00
[52] U.S. Cl. ..... 378/161; 378/34
[58] Field of Search ..... 378/161, 34

[56] References Cited

FOREIGN PATENT DOCUMENTS 64-9400 12/1989 Japan ..... 378/161

*Primary Examiner*—Craig E. Church
*Attorney, Agent, or Firm*—Fitzpatrick, Cella, Harper & Scinto

[57] ABSTRACT

An X-ray transmitting window for use in X-ray lithography, for allowing transmission therethrough of X-rays from a vacuum ambience to a different ambience, includes an X-ray transmitting film, and a gasket material gas-tightly provided on at least one of opposite surfaces in a peripheral portion of the X-ray transmitting film. The gasket material has a Brinell hardness smaller than that of the X-ray transmitting film. The formed X-ray transmitting window is able to be sandwiched and fastened between a pair of flanges in a gas-tight manner.

10 Claims, 6 Drawing Sheets

X-RAY TRANSMITTING WINDOW AND METHOD OF MOUNTING THE SAME

FIELD OF THE INVENTION AND RELATED ART

This invention relates generally to X-ray lithography or other X-ray technology and, more particularly, to an X-ray transmitting window with an X-ray transmitting film, which serves as a vacuum partition wall, allowing transmission therethrough of X-rays from a vacuum ambience to a non-vacuum ambience. In another aspect, the invention is concerned with a method of mounting such an X-ray transmitting window.

FIG. 8 shows a known example of an X-ray transmitting window, wherein an X-ray transmitting film 81 made from a beryllium sheet, for example, is gas-tightly fixed to a connecting member 82 which in turn is gas-tightly fixed to an inside cylindrical surface of a ring frame member 83. For the connection, silver brazing, electron beam welding, diffusion welding or the like is usable. This X-ray transmitting film 81 can serve as a vacuum partition wall, when fixed by bolts at bores 84 formed in the ring frame member 83.

SUMMARY OF THE INVENTION

With this example, however, it is necessary to use a specific large ring frame member in addition to ordinary vacuum flange means, resulting in increased cost and heavy weight.

On the other hand, in order to avoid oxidation and resultant damage of an X-ray transmitting film, it is desirable to keep the X-ray transmitting film in a gas-tight casing. With the structure shown in FIG. 8, however, because of the large size of the ring frame member, only a limited number of X-ray transmitting films can be accommodated in the casing of a particular size. Further, in such case, there is a high possibility of breakage of the connection between the X-ray transmitting film and the connecting member or the connection between the connecting member and the ring frame member. This causes an inconvenience of small vacuum leakage or damage of the X-ray transmitting film.

It is accordingly an object of the present invention to provide an X-ray transmitting widow structure which is light in weight and small in size, but which assures gas-tightness positively.

It is another object of the present invention to provide a method of mounting such an X-ray transmitting window structure.

In accordance with an aspect of the present invention, there is provided an X-ray transmitting window for use in X-ray lithography, for allowing transmission therethrough of X-rays from a vacuum ambience to a different ambience, wherein the window includes an X-ray transmitting film; and a gasket material gas-tightly provided on at least one of opposite surfaces in a peripheral portion of the X-ray transmitting film, the gasket material having a Brinell hardness smaller than that of the X-ray transmitting film. The formed X-ray transmitting window is able to be sandwiched and fastened between a pair of flanges gas-tightly.

In accordance with another aspect of the present invention, there is provided an X-ray transmitting window structure having a function as a vacuum partition wall device, for allowing transmission therethrough of X-rays from a vacuum ambience to a different ambience, wherein said structure comprises an X-ray transmitting film; an outer frame member for gastightly covering peripheral edge portions of opposite sides of said X-ray transmitting film; and a pair of flange means for sandwiching and fastening therebetween said outer frame member, said flange means being made of a material having a Brinell hardness greater than that of said outer frame member.

An X-ray transmitting window to which the present invention pertains should have a higher X-ray transmissivity. This means that an X-ray transmitting film should be thinner, in this respect. On the other hand, since the X-ray transmitting window serves as a vacuum partition wall between a vacuum ambience and a different, non-vacuum ambience, there exists a pressure difference across the X-ray transmitting film. This applies a tensile stress to the X-ray transmitting film. If the tensile stress becomes larger than the breaking stress of the film, the film is broken. In this respect, the X-ray film should have a thickness sufficient for avoiding breakage by the pressure difference.

Where a differential pressure p is applied to the opposite surfaces of a very thin film made of a material having a Young's modulus E and a large flexure is caused thereby, if the thickness of the film is h, then the tensile stress $\sigma$ at the center of the film of a circular shape is expressed as follows:

$$\sigma = 0.29\sqrt{(E \cdot p^2 \cdot S)/h^2}$$

where S is the area of the film and $S=\pi a^2$ (wherein a is the radius).

Also, the tensile stress at the center of a film of a square shape is given by:

$$\sigma = 0.25\sqrt{(E \cdot p^2 \cdot S)/h^2}$$

The tensile stress of the film at the center of a film where it has an elliptical shape or a oblong shape, is slightly smaller than that of a circular or square film.

From the above two equations, it is seen that a smaller tensile stress is attainable by increasing the film thickness. Also, it is attainable by reducing the area of the film. In consideration thereof, an X-ray transmitting film of the X-ray transmitting window of the present invention should desirably have a size (area) small enough but sufficiently large for attaining the function as an X-ray transmitting window. With regard to the film thickness, the film should desirably be as thin as possible but of a thickness sufficiently large to prevent overcoming of the tensile stress beyond the breaking stress.

As an example, the present invention is suitably applicable to an X-ray transmitting window structure in an X-ray lithographic exposure apparatus. Such an X-ray exposure apparatus is suited for manufacture of integrated circuit devices of 64 megabit DRAMs having an expected chip size of $10\times20$ ($mm^2$). Since an X-ray transmitting window is disposed closer to a light source side than a mask is and, generally, X-rays from the light source are divergent, there is a necessity that at the X-ray transmitting window position an X-ray transmission area slightly smaller than the area of $10\times20$ ($mm^2$) is defined. Further, in future X-ray lithography for a 4 gigabit DRAM having an expected chip size of $30\times60$ ($mm^2$), a required X-ray transmission area at the X-ray transmitting window position will be slightly smaller than the chip size.

On the other hand, in X-ray lithography, there is a possibility that the X-ray transmitting film is scanningly moved along a one-dimensional direction, for effective expansion of the X-ray transmission area. In such case, in order to assure X-ray irradiation of the whole area of the chip size corresponding to the X-ray irradiation region, an X-ray transmitting window having an X-ray transmission area with a length at either side sufficiently covering only one of the longitudinal side and the transverse side of the chip size, may be prepared and such X-ray transmitting window may be scanningly moved along the longitudinal side or the transverse side by a distance corresponding to the length thereof. In such occasion, by making the scanning distance shorter than the length of the one side of the chip size, it is possible to provide an X-ray transmitting window of increased strength. Since the one side of the chip size has a length in a range of 10–60 mm, the longitudinal length of the X-ray transmitting area should be not less than 10 mm. On the other hand, if the X-ray transmitting area has a size larger than a required, the strength of the X-ray transmitting window decreases and, in this case, the thickness of the X-ray transmitting film may be made larger to assure a sufficient strength resistive to breakage. However, making the film thickness so large is not desirable. It is therefore preferable that the longitudinal length of the X-ray transmitting area is made not greater than 60 mm.

Where an X-ray transmitting window is not scanningly moved, clearly it is necessary to define at the window position an X-ray transmitting area of a size allowing transmission of X-rays for exposure of the chip size. Thus, the longitudinal length should be in a range of 20–60 mm. In summary, it can be stated that an X-ray transmitting window should preferably have an X-ray transmitting area of a size ranging from 10 mm to 60 mm.

In an X-ray transmitting window structure according to one aspect of the present invention, an outer frame member adjoining to an X-ray transmitting film is sandwiched and fastened between a pair of flanges each having a Brinell hardness larger than that of the outer frame member. Thus, when fastened between the flanges, there occurs plastic deformation of the outer frame member, causing intimate contact of the outer frame member with the flanges. Thus, high gas-tightness is ensured.

In another aspect of the invention, each flange is provided with a seal edge (sealing projection) which bites into an opposed outer frame member when the latter is sandwiched and fastened between the flanges. This effectively improves the sealing property. Further, where the material of the outer frame member has a Brinell hardness smaller than that of the X-ray transmitting film, the fastening of the outer frame member between the flanges with resultant deformation of the outer frame member or with resultant biting of the seal edge of the flange into the outer frame member, does not cause deformation of the X-ray transmitting film itself which otherwise results in damage of the strength thereof.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
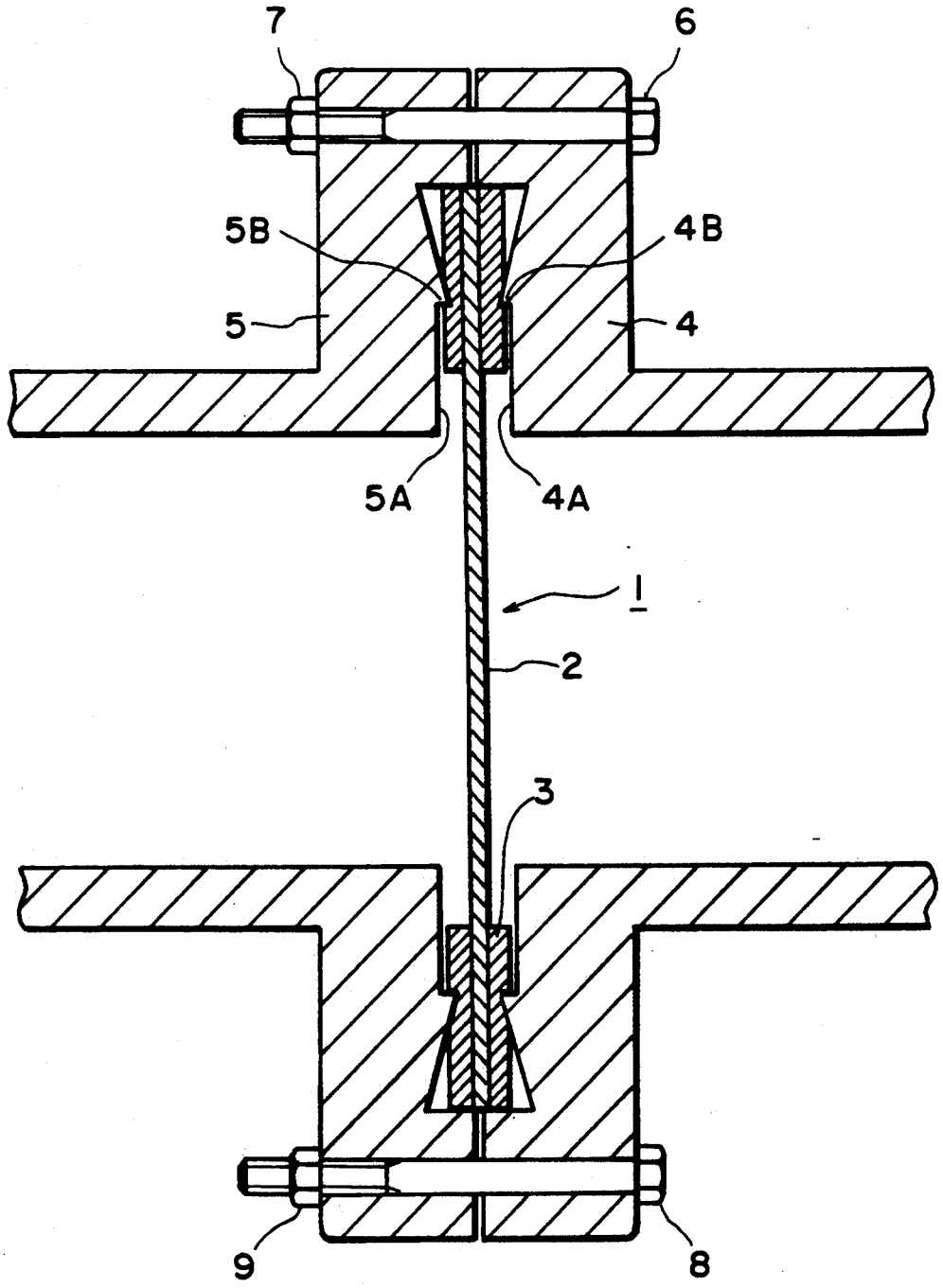
FIG. 1 is a sectional view of a first embodiment of an X-ray transmitting window structure, according to the present invention.

FIG. 1 is a sectional view of a first embodiment of an X-ray transmitting window structure, according to the present invention.

The structure includes a window member 1 which comprises an X-ray transmitting film 2 and two ring-like outer frame members (gasket members) 3 gas-tightly adjoining to outer peripheral portions of the opposite surfaces of the film 2. The window member 1 is fastened between and fixedly supported by flanges 4 and 5 of tubular members which define an X-ray beam line for an X-ray exposure apparatus, for example.

Figure 2:
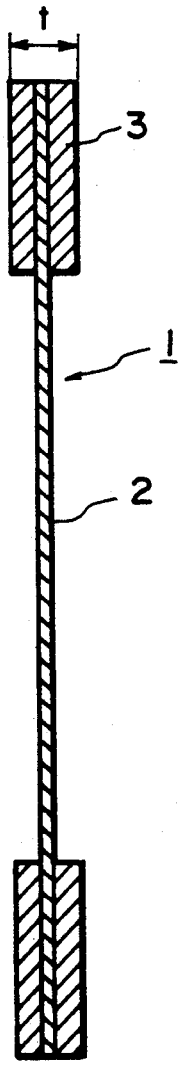
FIG. 2 is a sectional view of a first embodiment of a window member consisting of an X-ray transmitting film and frame means (gasket means), according to the present invention.

Each of the flanges 4 and 5 is made of a material having a Brinell hardness larger than that of the outer frame members 3. In the contact surfaces of these flanges which are opposed to each other so as to support the window member 1 therebetween, there are formed inside circumferential recesses 4A and 5A for receiving and abutting against portions of the outer frame members 3, respectively. Each recess 4A or 5A has a flat bottom surface extending from a central part of the flange to its inner peripheral edge. At the central part, there is formed a ring-like seal edge 4B (5B) projecting perpendicularly from the flat bottom surface and having a slant surface obliquely extending from the ridge of the projection toward the outer peripheral edge of the flange. The spacing between the opposed flat bottom surfaces of the recesses 4A and 5A as the flanges 4 and 5 are joined to each other, is set to be substantially equal to the thickness of the outer frame 3 portion of the window member 1. The outer peripheral edge of each recess 4A (5A) extends along the outer peripheral edge of the window member 1. In this window member 1, as best seen in FIG. 2, the gaskets or outer frame members 3 of a suitable width and a suitable thickness are provided on the both side surfaces of the X-ray transmitting film 2, with the outer peripheral edge of each outer frame member being aligned with the outer peripheral edge of the film 2.

In the X-ray transmitting window structure of this embodiment, the window member 1 is sandwiched between the flanges 4 and 5 and fastened therebetween by means of bolts 6 and 8 and nuts 7 and 9, while at the recesses 4A and 5A the seal edges 4B and 5B are press contacted to the outer frame members 3. Since the flanges 4 and 5 each is made of a material having a Brinell hardness larger than that of the outer frame members 3 adjoining to the X-ray transmitting film 2, each seal edge 4B or 5B formed on the flange 4 or 5 bites into corresponding one of the outer frame members 3 while causing plastic deformation thereof. This assures good gas-tightness at the X-ray transmitting window.

Figure 3:
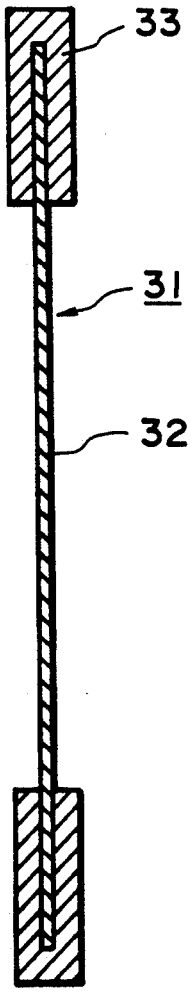
FIG. 3 is a sectional view of a second embodiment of a window member for an X-ray transmitting window structure, according to the present invention.

FIG. 3 shows another embodiment of X-ray transmitting window member of the present invention.

As shown in FIG. 3, the window member 31 has an integral outer frame member (gasket) 33 of a predetermined width, which is provided on an X-ray transmitting film 32 so as to wrap the outer peripheral edge portion of the film 32. The outer frame member has an outer diameter which is larger than that of the film 32, and the thickness of the circumferential outer frame 33 portion is constant.

By fastening and fixing this window member 31 by using flanges such as at 4 and 5 shown in FIG. 1, good gas-tightness is assured similarly.

In the embodiment of FIG. 1, there is a possibility that the outer circumferential edge of the X-ray transmitting film 1 is continuously exposed to the atmosphere and, as a result, oxidization and consequent damage occurs at this portion. In the present embodiment, as compared therewith, the outer frame member 33 is provided so as to wrap the peripheral edge portion of the X-ray transmitting film 32. Therefore, the film 32 can be protected against contact to the atmosphere and it is possible to avoid oxidization and resultant damage of the film 32.

Here, typical materials usable as the X-ray transmitting film as well as their Brinell hardness are shown in Table 1, below. Also, typical materials usable as the outer frame member (gasket) to be provided on the film as well as their Brinell hardness are shown in Table 2, below. Further, typical materials usable as the flange as well as their Brinell hardness are shown in Table 3below.

It is to be noted that the outer frame member should preferably be made of a material having a sufficiently small Brinell hardness as compared with that of the material used for the flange.

TABLE 1

| Film Material | Brinell Hardness ($H_B$) |
|---|---|
| Be | 90–120 |
| Ag | 20–25 |
| Ni | 100–110 |
| Al | 17 |

TABLE 2

| Frame Material | Brinell Hardness ($H_B$) |
|---|---|
| Al | 17 |
| Cu | 75 |
| Au | 25 |

TABLE 3

| Flange Material | Brinell Hardness ($H_B$) |
|---|---|
| SUS | <183 |
| SUS 316L | <183 |

Practical examples of the foregoing embodiment will be explained below.

EXAMPLE 1

First, an X-ray transmitting window structure which uses a window material 1 such as shown in FIG. 2 will be explained.

The X-ray transmitting film 2 was made from a beryllium film of a circular shape, having a thickness 60 microns and a diameter 82.4 mm. The flanges 4 and 5 each were made of stainless steel (SUS 316L). Each flange is of a known type which is available as Model ICF114 from ANELVA Corp., having a recess (4A or 4B) with a seal edge (4B or 5B) formed at an inside peripheral edge portion of a surface to be opposed to the other flange. In each outer peripheral edge portion of the opposite side surfaces of the X-ray transmitting film 2, electroplating by nickel to a thickness of 20 microns was made to a circumferential area of an inner diameter 63.7 mm and an outer diameter 82.4 mm, along the seal edge 4B or 5B of the flange 4 or 5. Additionally, electroplating by copper was made to the outside surfaces of that portion, to a thickness of 950 microns, whereby the outer frame members 3 were formed. The outer frame members 3 and the X-ray transmitting film 2 of the thus formed window member 1 had their outer peripheral edges aligned with each other. The total thickness t of the outer frame member 3 portion, including the thickness of the X-ray transmitting film 2, was 2 mm.

The thus formed window member 1 was sandwiched between the flanges 4 and 5, with the seal edges 4B and 5B engaging with the outer frame members 3 at the opposite sides of the window member, and it was fastened by the bolts 6 and 7 and the nuts 7 and 9 with a screw torque of 120 Kg·cm, whereby a vacuum partition wall was provided. Since each outer frame member 3 provided on the X-ray transmitting film 2 had a surface layer of copper having a Brinell hardness (75 $H_B$) smaller than that of stainless steel (180 $H_B$), the seal edges 4B and 5B of the flanges 4 and 5 bit into the outer frame members 3 of the window member 1, with a result of plastic deformation of the outer frame members 3, whereby gas-tightness was assured.

Across the obtained X-ray transmitting window, an ultra-high vacuum ambience (not higher than $1\times10^{-8}$ Torr) and a gas ambience filled with helium gas (150 Torr) were given, and vacuum leakage measurement was effected. The result is that no leakage was measured.

EXAMPLE 2

Next, an X-ray transmitting window structure using a window material 31 such as shown in FIG. 3 will be explained.

In this example, a circular X-ray transmitting film 32 was formed by a beryllium film of a thickness 20 microns and, to that film, the outer frame member (gasket) 33 was provided so as to wrap the outer peripheral edge portion of the film, whereby the window member 31 was formed. The outer frame member 33 was formed on the X-ray transmitting film 32 by aluminium deposition with uniform thickness, in a concentric ring area of an outer diameter 82.4 mm and an inner (opening) diameter 35 mm. The thickness was 2 mm. In this example, the X-ray transmitting film 32 may have any diameter provided that it is within the range of the outer frame member 33 and, if so, the outer peripheral edge portion of the X-ray transmitting film 32 can be wrapped by the outer frame member 33.

In a similar manner as described, the window member 31 having the X-ray transmitting film 32 and the outer frame member 33 provided thereon was sandwiched between the flanges 4 and 5, with their seal edges 4B and 5B engaging with the outer frame member 33, and it was fastened by means of the bolts 6 and 8 and the nuts 7 and 9 with a screw torque 120 Kg·cm, whereby a vacuum partition wall was provided.

The outer frame member was made of aluminium whose Brinell hardness (17 $H_B$) was smaller than that of stainless steel (180 $H_B$). Thus, the seal edges 4B and 5B of the flanges 4 and 5 bit into the opposite sides of the outer frame member 33 with plastic deformation thereof.

Across the obtained X-ray transmitting window, an ultra-high vacuum ambience (not higher than $1\times10^{-8}$ Torr) and a gas ambience filled with helium gas (150 Torr) were given, and vacuum leakage measurement was effected. The result is that no leakage was measured.

EXAMPLE 3

Figure 4:
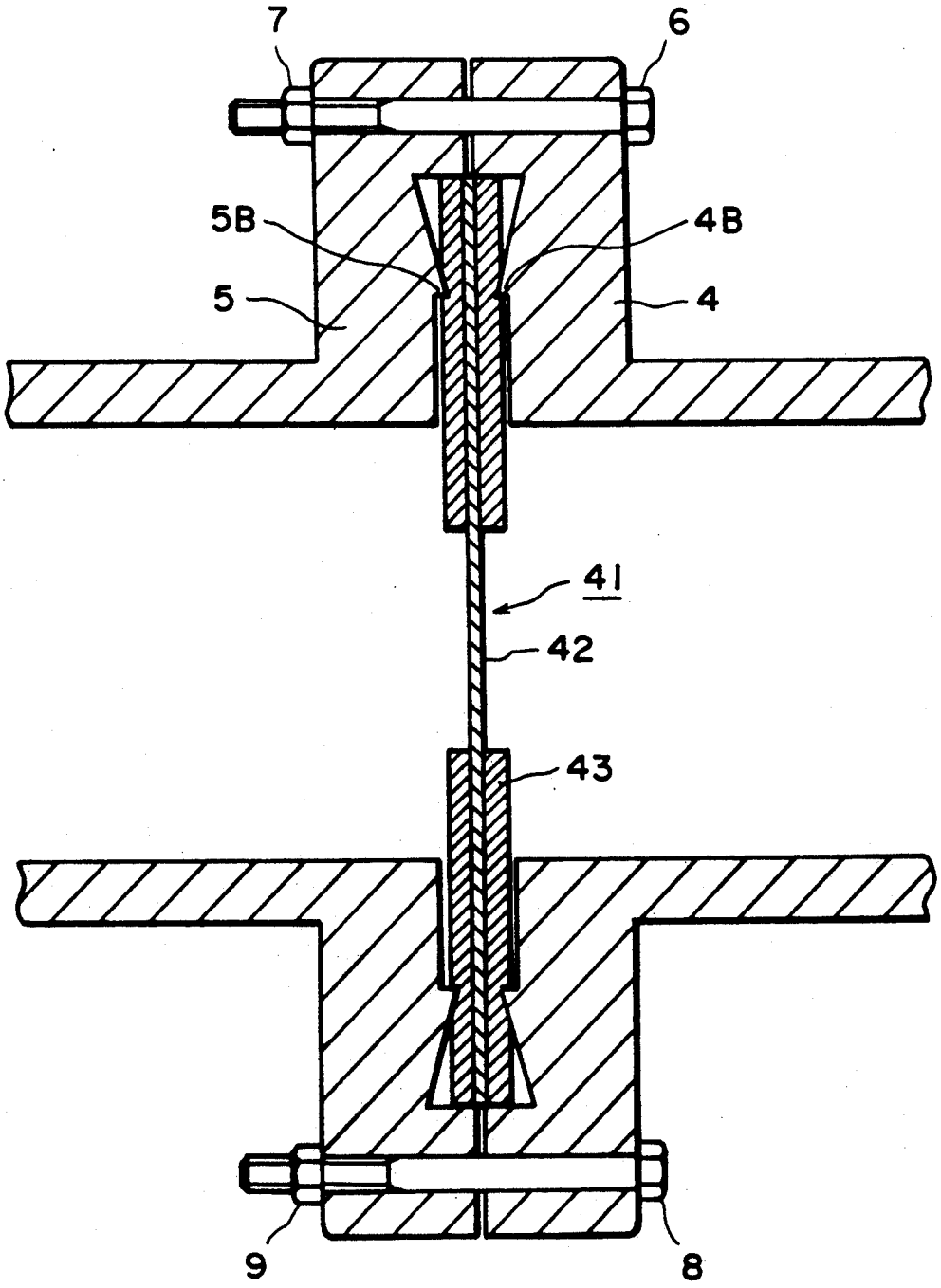
FIG. 4 is a sectional view of a second embodiment of an X-ray transmitting window structure, according to the present invention.

A third example will be explained with reference to FIG. 4.

In this example, like the window member 1 shown in FIG. 2, a window member 41 has outer frame members 43 which are provided, with desired width and thickness, on both sides of an X-ray transmitting film 42, with the outer peripheral edges of them being aligned with the outer peripheral edge of the film 42.

In this window member 41, an opening for transmission of X-rays therethrough which is defined by the provision of the outer frame members 43, is defined so as to have a size slightly larger than the area through which the X-rays should actually be passed.

In this example, the length of each side of the opening is made larger by about 1 mm than the length of each side of the area through which the X-rays should actually be passed. This is determined in consideration of the fact that, at the position of the X-ray transmitting film 42, the X-rays are oscillated perpendicularly to the direction of X-ray projection in a range of several hundred microns.

Like Example 1, a beryllium film was used as the X-ray transmitting film 42 and copper was used for the outer frame members 43. The opening had a size of 25 mm square which is slightly larger than the size of the area through which the X-rays should actually pass. Since the opening had a size of 25 mm square, it was possible that the beryllium film (X-ray transmitting film) 42 had a thickness of 15 microns.

Like Example 1, the thus formed window member was sandwiched between flanges 4 and 5 with their seal edges 4B and 5B engaging with the both sides of the outer frame members 43, and it was fastened to an X-ray exposure apparatus by means of bolts 6 and 8 and nuts 7 and 9, whereby a vacuum partition wall was provided.

An X-ray exposure apparatus which utilizes synchrotron radiation as a light source, mainly uses a wavelength range of 0.7–1.0 nm. Investigation was made about the transmissivity to soft X-rays of 0.8 nm as an example, with regard to an X-ray transmission window using a beryllium film of a thickness 15 microns (Example 3) and an X-ray transmitting window using a beryllium film of a thickness 60 microns (Example 1). The result is that the beryllium film of 60 micron thickness showed a transmissivity of 17%, but the beryllium film of 15 micron thickness showed a higher transmissivity of 64%. Since in the X-ray exposure apparatus the X-ray transmissivity, i.e., the intensity of transmitted X-rays, has a direct effect on the throughput of exposure process, the improvement in the transmissivity as described above essentially results in a significant increase in the throughput.

Figure 5A:
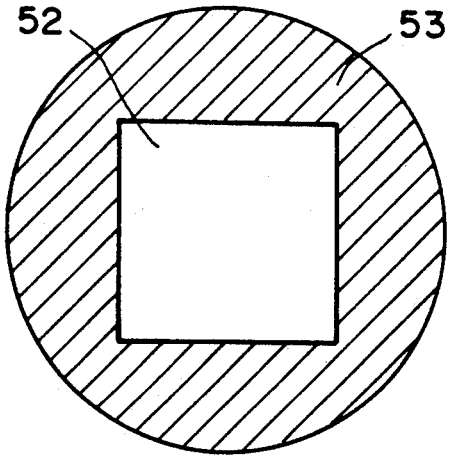
FIGS. 5A–5F are schematic views, respectively, showing examples of openings as defined by X-ray transmitting windows of the present invention.
Figure 5B:
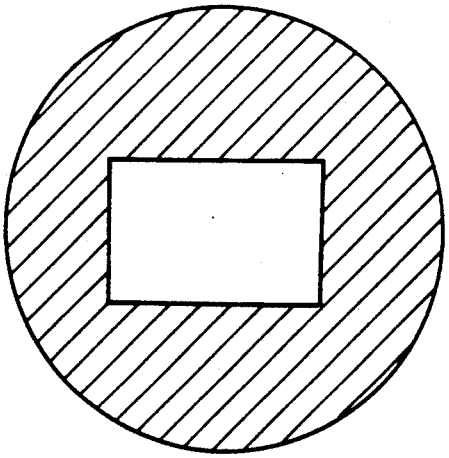
Figure 5C:
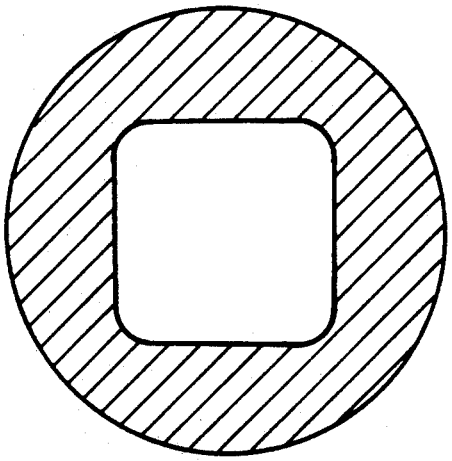
Figure 5D:
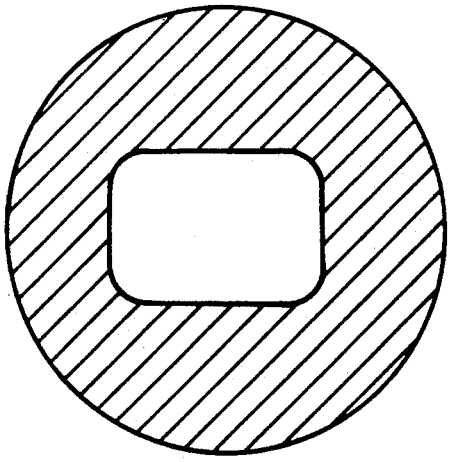
Figure 5E:
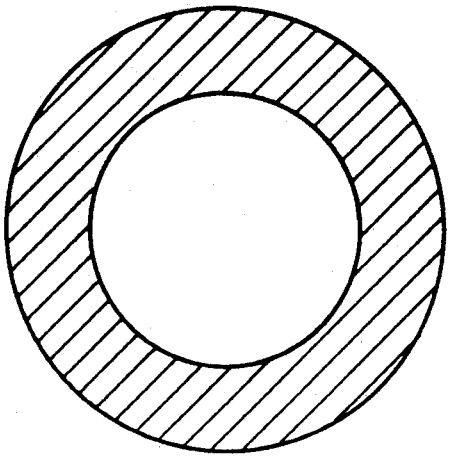
Figure 5F:
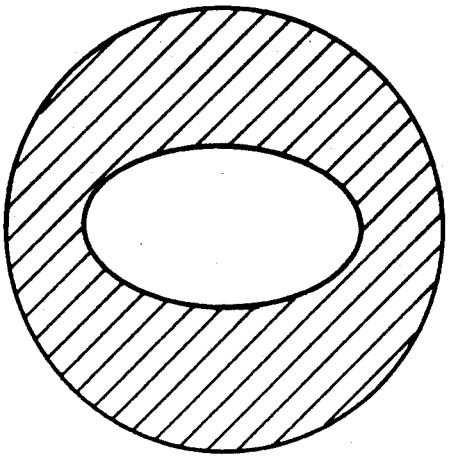

While in Example 3 the opening as defined by the outer frame members have a square shape, any other shape may be used. Examples are illustrated in FIGS. 5A–5F. Of these drawings, FIG. 5A shows a square shape similar to Example 3. FIG. 5B shows an oblong shape. FIGS. 5C and 5D show those shapes as formed by rounding the corners of a square shape and an oblong shape, respectively. FIGS. 5E and 5F show a circular shape and an elliptical shape, respectively. Other than those, a pentagonal shape or any other polygonal shape or a shape as can be defined by rounding such a polygonal shape, may be used.

Figure 6:
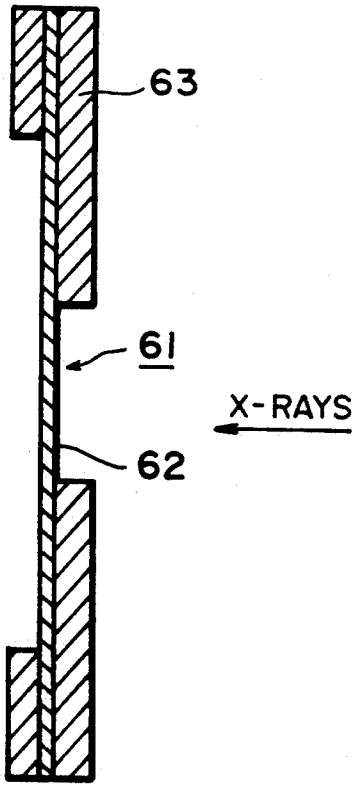
FIG. 6 is a sectional view of a third embodiment of a window member for an X-ray transmitting window structure, according to the present invention.
Figure 8:
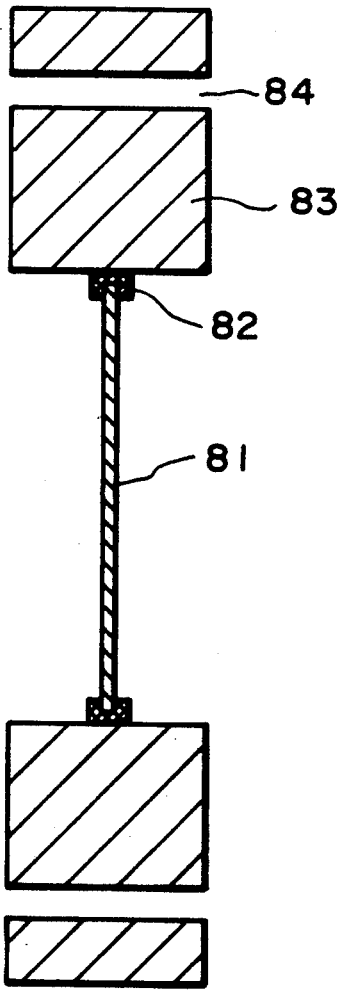
FIG. 8 is a sectional view of a known example of an X-ray transmitting window structure.

In Example 3, the outer frame members 43 adjoining the opposite sides of the X-ray transmitting film 42 have the same shape. However, this is not a requisition. That is, as shown in FIG. 6, a window member 61 may have an outer frame member 63 formed to adjoin the surface of an X-ray transmitting film 62 which is on the X-ray input side of the film, wherein this outer frame member defines an opening of a size slightly larger than the area through which the X-rays should actually be passed.

EXAMPLE 4

Figure 7:
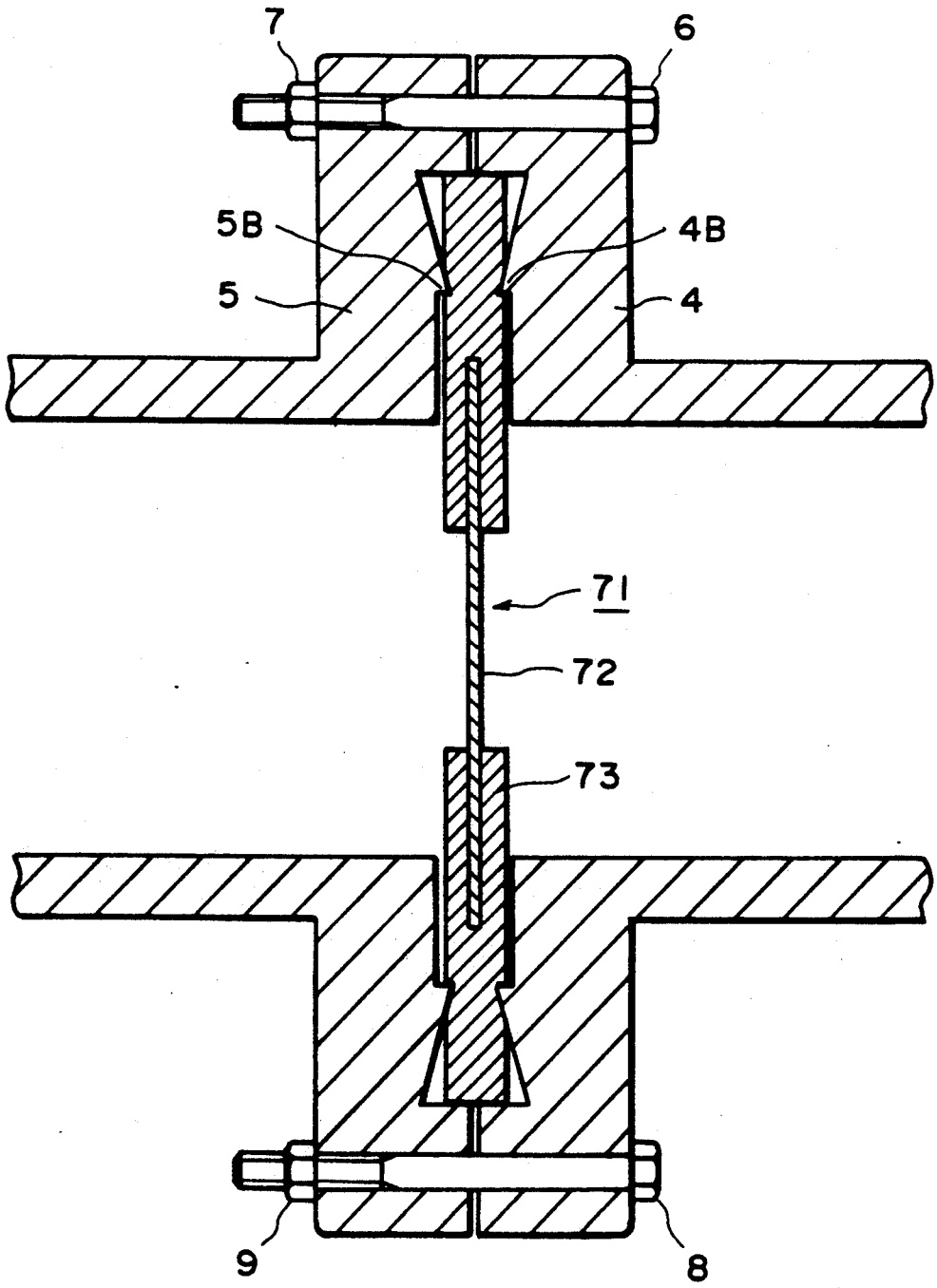
FIG. 7 is a sectional view of a third embodiment of an X-ray transmitting window structure, according to the present invention.

A fourth example will be explained with reference to FIG. 7.

In this example, like the window member 31 shown in FIG. 3, an integral outer frame member 73 adjoins to an X-ray transmitting film 72 so as to wrap the outer peripheral edge portion of the film 72. Also, like the window member 41 shown in FIG. 4, the opening to be defined for X-ray transmission has a size slightly larger than that of the area through which the X-rays should actually pass.

In the window member 71 of this example, a beryllium film is used as the X-ray transmitting film 72, but its outer diameter is made smaller than the seal edge (ring) 4B or 5B formed on the flange 4 or 5. Thus, as the window member 71 is fastened and fixed between the flanges 4 and 5, the seal edges 4B and 5B bite into those portions of the outer frame member 73 whereat no X-ray transmitting film is embedded, as seen in FIG. 7.

Also in this example, the outer frame member 73 can be provided integrally to the X-ray transmitting film 72 by means of electroless plating, for example. Therefore, a sufficient strength as of an X-ray transmitting film resistive to breakage, is ensured and thus substantially the same advantageous effects as attainable with Examples 1–3 are assured.

In the examples described hereinbefore, the X-ray transmitting film is provided by a beryllium film. However, in accordance with an X-ray wavelength range to be used, there is or are suitable materials to be used. Thus, depending on a wavelength to be used, a metal material such as silver, nickel, aluminium or the like, an insulative material or a semiconductive material such as silicon, carbon (diamond thin film), silicon nitride, silicon carbide and the like, may of course be used.

In the foregoing examples, for a beryllium X-ray transmitting film, copper or aluminium is used as the material for forming the outer frame member (gasket). However, a material having a Brinell hardness not greater than 120 $H_B$, such as gold, for example, may be used as the outer frame member.

Where silver is used as the material for the X-ray transmitting film, a material having a Brinell hardness not greater than 23 $H_B$ (e.g. aluminium) may preferably be used for the material of the outer frame member.

Where nickel is used as the material for the X-ray transmitting film, a material having a Brinell hardness not greater than 110 $H_B$ (e.g. aluminium, copper, gold) may preferably used for the material of the outer frame member.

Where aluminium is used as the material for the X-ray transmitting film, a material having a Brinell hardness not greater than 17 $H_B$ (e.g. aluminium) may be used for the material of the outer frame member.

Where carbon, silicon nitride, silicon carbide or silicone is used as the material for the X-ray transmitting film, a material having a Brinell hardness not greater than 120 $H_B$ (e.g. aluminium, copper, gold) may preferably used for the material of the outer frame member.

While the vacuum leakage measurements were made under the condition that one side of the X-ray transmitting window was filled with a helium gas of 150 Torr, if the thickness of the X-ray transmitting film is so selected as to sufficiently resist breakage of the film due to the pressure difference, an atmospheric pressure or a pressure higher than this may be set. Further, other than the helium gas ambience, an ambience of nitrogen gas, argon gas or atmospheric gas may be used provided that it does not damage the used X-ray transmitting film.

Further, while in the foregoing examples the outer frame member is made by plating or deposition, the outer frame member may be made separately by using a material of copper, for example, and the formed outer frame member may be adhered to the X-ray transmitting film by silver brazing. Alternatively, it may be formed by fusing a material having a melting point lower than that of the used X-ray transmitting film material.

While the invention has been described with reference to the structures disclosed herein, it is not confined to the details set forth and this application is intended to cover such modifications or changes as may come within the purposes of the improvements or the scope of the following claims.

What is claimed is:

1. An X-ray transmitting window structure functioning as a vacuum partition wall device for allowing transmission therethrough of X-rays from a vacuum ambience to a different ambience, said structure comprising:

an X-ray transmitting film;

an outer frame member for gas-tightly covering peripheral edge portions of opposite sides of said X-ray transmitting film; and a pair of flange means for sandwiching and fastening therebetween said outer frame member, said flange means being made of a material having a Brinell hardness greater than that of said outer frame member.

2. A structure according to claim 1, wherein said pair of flange means have opposed surfaces each having an inside circumferential recess for receiving said X-ray transmitting film, wherein each recess has a flat bottom surface extending from a central part to an inside circumferential edge, and wherein each recess is formed with a sealing edge at said central part thereof which is defined by a circumferential projection projecting perpendicularly from said flat bottom surface and having a slanted surface inclined from a ridge of said projection toward an outside circumferential edge of said recess.

3. A structure according to claim 1 or 2, wherein the Brinell hardness of said outer frame member is smaller than that of said X-ray transmitting film.

4. A structure according to claims 1 or 2 wherein a total thickness of an outside circumferential edge portion of said X-ray transmitting film and said outer frame member adjoining thereto is in a range of 0.2–10 mm.

5. A structure according to claim 1 or 2 wherein a portion of the surface of said X-ray transmitting film not covered by said outer frame member has one of a rectangular shape, a pentagonal shape, another polygonal shape, a shape without a corner, a circular shape and an elliptical shape, and wherein said portion not covered by said outer frame member has a longitudinal size in a range of 10–60 mm.

6. A method of mounting an X-ray transmission film functioning as a vacuum partition wall for allowing transmission therethrough from a vacuum ambience to a different ambience, said method comprising the steps of:

gas-tightly providing an outer frame member on outer peripheral edge portions of opposite sides of the X-ray transmitting film; and sandwiching and fastening the outer frame member between a pair of flanges, wherein the outer frame member has a Brinell hardness smaller than that of the flange.

7. An X-ray transmitting window, for use in X-ray lithography, for allowing transmission therethrough of X-rays from a vacuum ambience to a different ambience, comprising:

an X-ray transmitting film; and a gasket material gas-tightly provided integrally on opposite surfaces in a peripheral portion of said X-ray transmitting film, said gasket material having a Brinell hardness smaller than that of said X-ray transmitting film.

8. An X-ray transmitting window for use in X-ray lithography, for allowing transmission therethrough of X-rays from a vacuum ambience to a different ambience, comprising:

an X-ray transmitting film; and a gasket material gas-tightly provided on at least one of opposite surfaces in a peripheral portion of said X-ray transmitting film, said gasket material having a Brinell hardness smaller than that of said X-ray transmitting film, wherein said gasket material is provided on said X-ray transmitting film by plating.

9. An X-ray transmitting window for use in X-ray lithography, for allowing transmission therethrough of X-rays from a vacuum ambience to a different ambience, comprising:

an X-ray transmitting film; and a gasket material gas-tightly provided on at least one of opposite surfaces in a peripheral portion of said X-ray transmitting film, said gasket material having a Brinell hardness smaller than that of said X-ray transmitting film, wherein a pair of gasket materials are provided on opposite surfaces in the peripheral portion of said X-ray transmitting film.

10. An X-ray transmitting window for use in X-ray lithography, for allowing transmission therethrough of X-rays from a vacuum ambience to a different ambience, comprising:

an X-ray transmitting film; and a gasket material gas-tightly provided on at least one of opposite surfaces in a peripheral portion of said X-ray transmitting film, said gasket material having a Brinell hardness smaller than that of said X-ray transmitting film, wherein an integral gasket material is provided to cover opposite surfaces in the peripheral portion of said X-ray transmitting film.

* * * * *

UNITED STATES PATENT AND TRADEMARK OFFICE

CERTIFICATE OF CORRECTION

PATENT NO. : 5,159,621

DATED : October 27, 1992

INVENTOR(S) : Yutaka Watanabe, et al.

It is certified that error appears in the above-identified patent and that said Letters Patent is hereby corrected as shown below:

Title Page:

[56] REFERENCES CITED:

Insert --U.S. PATENT DOCUMENTS

| | | | |
|---|---|---|---|
| 2,449,872 | 9/1948 | Brasch, et al. | 250/154 |
| 2,909,686 | 10/1959 | Zunick | 313/59 |
| 4,196,367 | 04/1980 | Diemer, et al. | 313/59 |
| 4,240,491 | 12/1980 | Bish, et al. | 160/380 |

FOREIGN PATENT DOCUMENTS 2389227 11/1978 France 0244504 11/1987 Europe

"64-9400 12/1989 Japan" should read --64-9400 1/1989 Japan--.

OTHER DOCUMENTS

R.A. Tobin, "Simple, Bakeable, Thin Vacuum Window", Review of Scientific Instruments, Vol. 34, No. 12, pp. 1450-1451 (December 1963).--.

COLUMN 1:

Line 45, "widow" should read --window--.

COLUMN 2:

Line 1, "gastightly" should read --gas-tightly--.

UNITED STATES PATENT AND TRADEMARK OFFICE

CERTIFICATE OF CORRECTION

PATENT NO. : 5,159,621 Page 2 of 2

DATED : October 27, 1992

INVENTOR(S) : Yutaka Watanabe, et al.

It is certified that error appears in the above-identified patent and that said Letters Patent is hereby corrected as shown below:

COLUMN 10:

Line 15, "claims" should read --claim--.

Signed and Sealed this

Thirty-first Day of May, 1994

Bruce Lehman

*Attest:*

BRUCE LEHMAN

*Attesting Officer*

*Commissioner of Patents and Trademarks*